US009630695B2

(12) United States Patent
Reed

(10) Patent No.: US 9,630,695 B2
(45) Date of Patent: Apr. 25, 2017

(54) SIDE-MOUNTED TROLLING MOTORS AND CONTROL SYSTEMS

(71) Applicant: Phillip Reed, Zimmerman, MN (US)

(72) Inventor: Phillip Reed, Zimmerman, MN (US)

( * ) Notice: Subject to any disclaimer, the term of this patent is extended or adjusted under 35 U.S.C. 154(b) by 0 days.

(21) Appl. No.: 15/061,199

(22) Filed: Mar. 4, 2016

(65) Prior Publication Data

US 2016/0257389 A1 Sep. 8, 2016

Related U.S. Application Data

(60) Provisional application No. 62/128,595, filed on Mar. 5, 2015.

(51) Int. Cl.

| | |
|---|---|
| ***B60L 11/00*** | (2006.01) |
| ***B63H 21/17*** | (2006.01) |
| ***B63H 20/00*** | (2006.01) |
| ***B63H 20/06*** | (2006.01) |
| ***B63H 20/10*** | (2006.01) |

(52) U.S. Cl.

CPC ..... *B63H 20/007* (2013.01); *B63H 20/06* (2013.01); *B63H 20/10* (2013.01); *B63H 2020/003* (2013.01)

(58) Field of Classification Search

CPC . B63H 5/07; B63H 5/08; B63H 20/00; B63H 20/007; B63H 20/02; B63H 20/06; B63H 20/08; B63H 20/10; B63H 25/42; B63H 2005/07; B63H 2005/08; B63H 2020/00; B63H 20/003; B63H 2020/02; B63H 2020/10; B63H 2025/42

USPC ... 440/6, 7, 49, 61 T, 63, 64, 65, 75, 79, 84, 440/86

See application file for complete search history.

(56) References Cited

U.S. PATENT DOCUMENTS

| | | | | |
|---|---|---|---|---|
| 4,008,680 A * | 2/1977 | Alexander, Jr. ..... | B63H 20/007 248/642 |
| 4,300,888 A * | 11/1981 | Warning ..... | B63H 21/265 114/144 R |
| 7,044,815 B1 * | 5/2006 | Symes ..... | B63H 20/12 440/7 |
| 7,086,914 B1 * | 8/2006 | Beamer ..... | B63H 21/30 440/53 |

* cited by examiner

*Primary Examiner* — Daniel V Venne
(74) *Attorney, Agent, or Firm* — Winthrop & Weinstine, P.A.

(57) ABSTRACT

A trolling motor assembly comprising a control assembly; a mounting assembly in electrical communication with the control assembly; and a propeller assembly having a motor. The mounting assembly comprises a control mounting bracket that is fixedly attached to a wall of the boat and a removable propeller mounting bracket that can be engaged with the control mounting bracket. When the propeller mounting bracket in an engaged position with the control mounting bracket, signals from an input device of the control assembly actuate the motor of the assembly.

13 Claims, 13 Drawing Sheets

SIDE-MOUNTED TROLLING MOTORS AND CONTROL SYSTEMS

CROSS-REFERENCE TO RELATED APPLICATIONS

This application claims priority to Application Ser. No. 62/128,595, entitled "Side-Mounted Trolling Motors and Control Systems" and filed on Mar. 5, 2015, and which is hereby incorporated by reference herein in its entirety.

FIELD OF THE INVENTION

The present disclosure relates generally to trolling motors for use with canoes, fishing boats, pontoon boats, and other boats.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Trolling motors typically comprise a control unit at an upper end, which is connected to a shaft; an electric motor disposed at a bottom end of the shaft and sealed within a watertight compartment for rotation of a propshaft; and a propeller fitted onto the end of the propshaft. Trolling motors are conventionally positioned only at the bow or stern of the boat. When not in use, the motor and propeller are stowed in a position such that the shaft is generally parallel to the water surface. When in use, the motor and propeller are below the surface of the water and the shaft is generally perpendicular to the water surface. Once disposed within the water, operators control the trolling motor via the control unit, which may allow the operator to trolling motor in one or more of the following modes: by hand using a tiller, by foot using a foot pedal, remotely using a wireless control system, or steerably using the driving wheel of the boat. These control mechanisms each have their own limitations in accuracy and precision of position of the rotating propeller shaft and speed control. The limited positions for the trolling motor (i.e. only parallel to the water surface or perpendicular to the water surface) may not provide adequate flexibility for positioning the shaft relative to the water surface.

There is a desire to provide a trolling motor with enhanced control flexibility and with additional positions relative to the water surface. Moreover, there is a desire for a trolling motor capable of being mounted on the port or starboard sides of the boat, as well as (or in the alternative to) mounting the motor on the stern or bow.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

The present disclosure, in one embodiment, relates to a mounting assembly for a trolling motor. The trolling motor mounting assembly comprises a control mounting bracket configured for electrical communication with a control assembly; and a propeller mounting bracket connected to a propeller assembly, the propeller assembly configured for operable connection with a shaft, a motor, and a propeller. In some embodiments, when the propeller mounting bracket is engaged with the control mounting bracket, the control assembly is in electrical communication with the propeller assembly for operation of the motor, and when the propeller mounting bracket is disengaged with the control mounting bracket, the control assembly is not in electrical communication with the propeller assembly. The control assembly may comprise an input device, and when the propeller mounting bracket is engaged with the control mounting bracket, the input device provides a signal to the propeller assembly to control at least one of a rotational speed of the propeller, a rotational direction of the propeller, a radial position of the propeller relative to the shaft, and a pitch of the propeller. In some embodiments, the propeller assembly is rotatably or pivotably connected to the propeller mounting bracket. The propeller assembly may be positioned between a fully deployed position, a stowed position, or a partially deployed position between the fully deployed position and the stowed position. In some embodiments, the shaft of the propeller assembly comprises a pivot point between a proximal end and a distal end thereof. In some embodiments, the control mounting bracket comprises a plate with a channel for receiving the propeller mounting bracket. In some embodiments, the control mounting bracket comprises at least one contact configured for electrical communication with the control assembly. The propeller mounting bracket may comprise at least one contact for electrical communication with at least one corresponding contact of the control mounting bracket when the propeller mounting bracket is engaged with the control mounting bracket. The propeller mounting bracket may comprise a shaft mounting bracket for connection with the shaft of the propeller. The shaft mounting bracket comprises a pin and slot assembly. In some embodiments, the mounting assembly may further comprise a locking mechanism for retaining the propeller mounting bracket in an engaged position with the control mounting bracket. In some embodiments, the control assembly is also in electrical communication with a second control mounting bracket, and the control mounting brackets are mounted on opposite walls of a boat.

In some embodiments, a method for controlling a boat is provided. The method comprises deploying a first propeller assembly from a port side of the boat, the first propeller assembly having a shaft, a motor, and a propeller; deploying a second propeller assembly from a starboard side of the boat, the second propeller assembly having a shaft, a motor, and a propeller; and controlling at least one of the propeller assemblies by providing an input signal from a control assembly to the at least one propeller assembly when the control assembly is in electrical communication with the at least one propeller assembly. In some embodiments, the first propeller assembly and the second propeller assembly are simultaneously controlled. In at least one embodiment, the boat is a pontoon.

In at least one embodiment, a trolling motor assembly comprises at least two propeller assemblies, each comprising a shaft, a motor, and a propeller; a propeller mounting bracket connected to each propeller assembly, wherein each propeller mounting bracket is mounted on an opposite side of a boat from at least one other propeller mounting bracket; and a single control assembly for controlling the motors of the at least two propeller assemblies. In at least one embodiment, the shaft of each propeller assembly is connected to the propeller mounting bracket and the shaft is pivotable relative to the propeller mounting bracket. Each propeller assembly may be positionable between a fully deployed position, a stowed position, or a partially deployed position between the fully deployed position and the stowed position, relative to the propeller mounting bracket. In some embodiments, a control mounting bracket is provided for each propeller mounting bracket, and each control mounting bracket in electrical communication with the single control assembly.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

Figure 1:
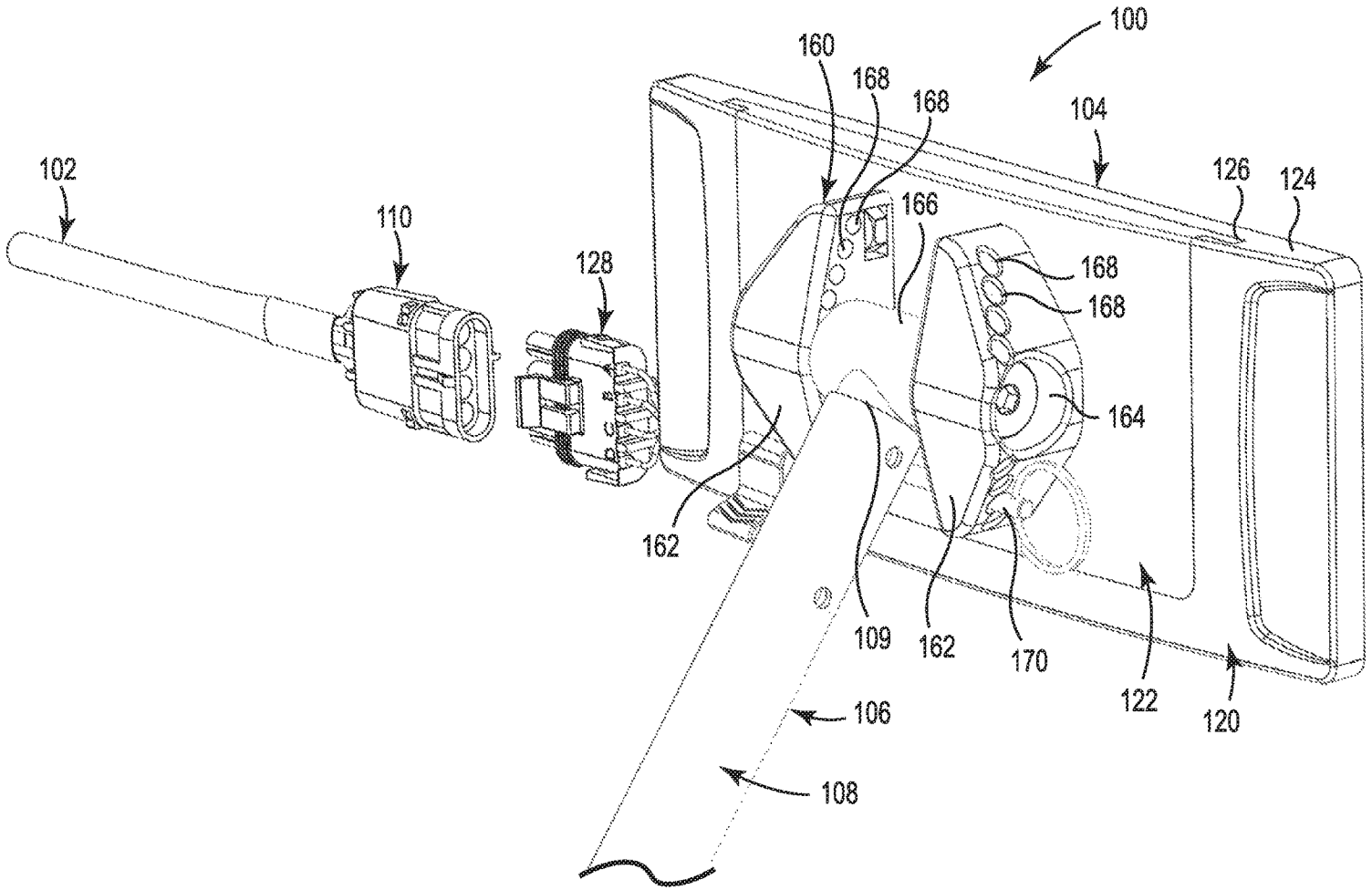
FIG. 1 is a front perspective view of a trolling motor assembly of one embodiment of the present disclosure.

The present disclosure relates to novel and advantageous trolling motor assemblies. One embodiment of the trolling motor assembly 100 of the present invention, as shown in FIGS. 1-4, comprises a control assembly 102; a mounting assembly 104 in electrical communication with the control assembly 102; and a propeller assembly 106 connected to the mounting assembly 104 and electrically connected to the control assembly 102. In some embodiments, the propeller assembly 106 comprises at least a shaft 108 having a proximal end (shown generally at 109) and a distal end opposite the proximal end, an electric motor (not shown) mounted to the shaft 108 at its distal end, and a propeller (not shown) driven by a propshaft (not shown) rotated by the electric motor. In some embodiments, the propeller assembly 106 may comprise a modified, "off the shelf" trolling motor which is adapted for connection to the mounting assembly 104 and the control assembly 102. In at least one embodiment, the mounting assembly 104 is capable of being attached to a wall surface of the boat along at least one of the port wall, stern wall, bow wall or starboard wall. However, it is also contemplated by this invention that the mounting assembly 104 is adapted to be attached to an interior surface of the boat. The propeller assembly 106 is rotatably connected to the mounting assembly so that it is pivotable relative to the wall surface of the boat.

In one embodiment shown in at least FIG. 1, the control assembly 102 comprises an input device having an electrical connector 110. The input device may be a joystick, gamepad, mobile device, steering wheel, or other controller. In at least one embodiment the input device comprises, for example, a three position joystick, 2-axis joystick, variable position joystick, or the like which may further be in electrical communication with a control box or power source of the boat. The electrical connector 110 connects the input device (either directly or via the control box) with the mounting assembly 104. The electrical connector 110 may be any standard electrical connector used with an input device or motor control device. The electrical connector 110 may comprise a physical connector to the mounting assembly having a plurality of wires as shown in FIG. 1 or it may make a wireless connection with the mounting assembly. The wires included may, in one embodiment, be standard trolling motor control wires. By way of the electrical connector 110, the input devices provides a signal to the mounting assembly 104 that determines one or more of the speed that the propeller is rotating, the direction of propeller rotation, the radial position of the propeller relative to the shaft 108, and the pitch of the propeller.

In at least one embodiment, the mounting assembly 104 comprises a control mounting bracket 120 and a propeller mounting bracket 122. In at least one embodiment, the control mounting bracket 120 is attached to a wall of the boat and in communication with the control assembly 102, and the propeller mounting bracket 122 is attached, and in some cases removably attached, to the propeller assembly 106. Propeller mounting bracket 122 removably engages with the control mounting bracket 120. FIG. 1 shows the propeller mounting bracket 122 engaged with the control mounting bracket 120 in an engaged position, and FIG. 2 shows a rear view of the propeller mounting bracket 122 detached from the control mounting bracket 120 in an unengaged position.

Figure 2:
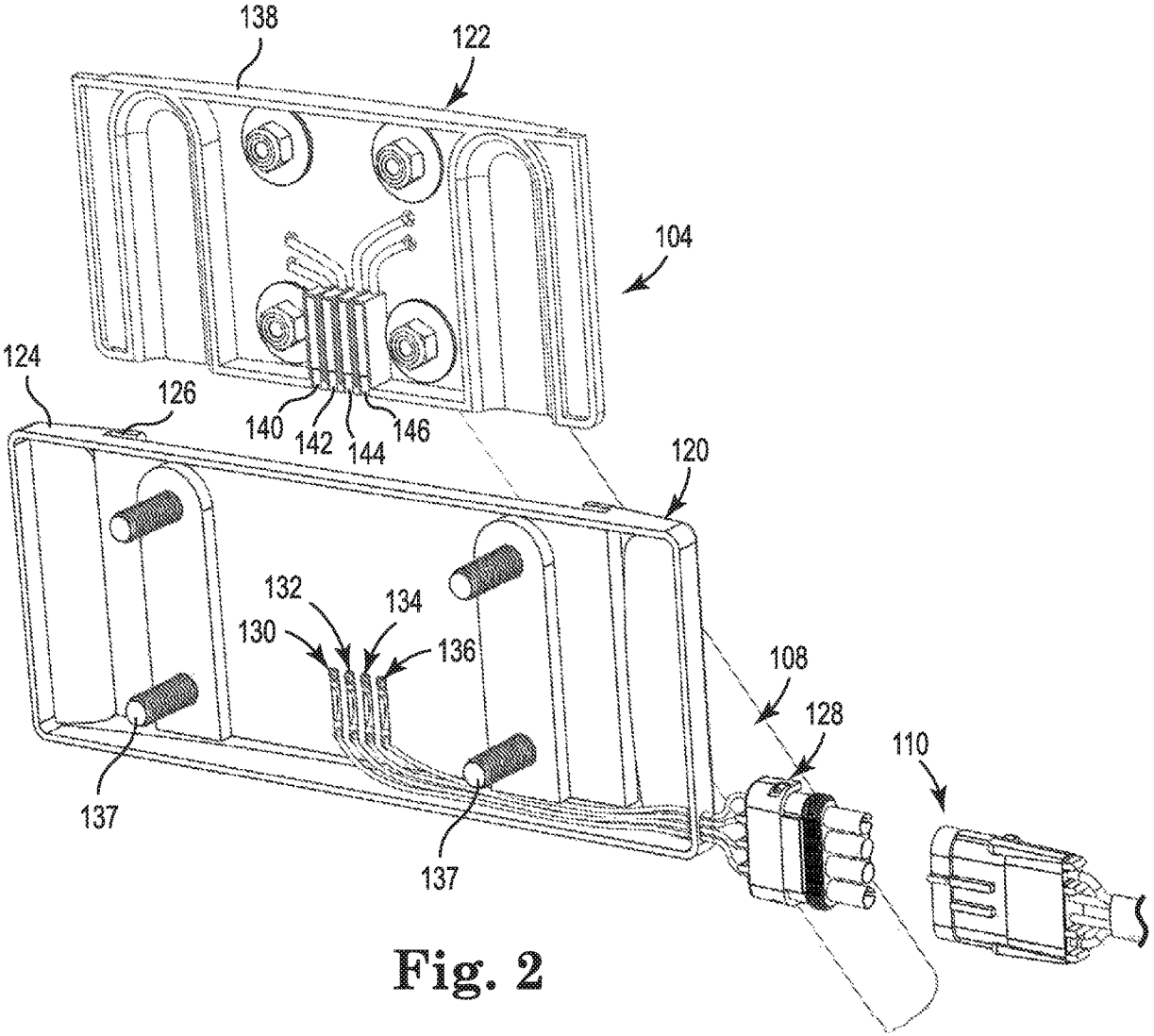
FIG. 2 is a rear view of a trolling motor assembly of a trolling motor assembly of one embodiment of the present disclosure.

In at least the embodiments shown in FIGS. 1 and 2, the control mounting bracket 120 comprises a plate 124 with a channel 126 capable of receiving the propeller mounting bracket 122; an electrical connector 128; and a plurality of contacts 130, 132, 134, 136 on the front of the plate in electrical communication with the electrical connector 128. The control mounting bracket 120 may be removably mounted to the wall of the boat using bolts 137 or another means of attaching the bracket to the boat. In at least the embodiment shown, the propeller mounting bracket 122 comprises a plate 138 and a plurality of contacts 140, 142, 144, 146. In some embodiments, the number of plurality of contacts 140, 142, 144, 156 of the propeller mounting bracket 122 is equivalent to the number of contacts 130, 132, 134, 136 on the plate 124 of the control mounting bracket 120. The propeller mounting bracket 122 may then slide into the channel 126 of the control mounting bracket 120 such that contacts 130, 132, 134, 136 become engaged with corresponding contacts 140, 142, 144, 146. When these contacts are engaged, signals from the input device of control assembly 102 can be transmitted to the motor and propeller of the propeller assembly 106.

In at least one embodiment, the shaft 108 is mounted, and in some cases removably mounted using conventional connection mechanisms, to the propeller mounting bracket 122. The shaft 108, which carries electrical wires that control operation of the motor and the propeller, is in electrical communication with the contacts 140, 142, 144, 146. Therefore, when the propeller mounting bracket 122 is engaged with the control mounting bracket 120, the propeller assembly 106 is in electrical communication with the control assembly 102. An electrical connector may be provided to connect the wires carried by the shaft 108 with wires of the propeller mounting bracket 122 and to facilitate the removal of the shaft from the propeller mounting bracket or the shaft mounting bracket, as discussed further below.

Additionally, the shaft 108 may be pivotably mounted to the propeller mounting bracket 122 as shown, and in some embodiments, the shaft 108 may be fixedly mounted such that it is positioned at an angle relative to the outer surface of the boat at an angle between about 0 and 180 degrees. By positioning the shaft at a generally downward angle, the motor and propeller can be in the water; by positioning the shaft at a generally upward angle, the motor and propeller can be above the water for storage, for example, while the boat is in relatively higher speed transport.

Figure 3:
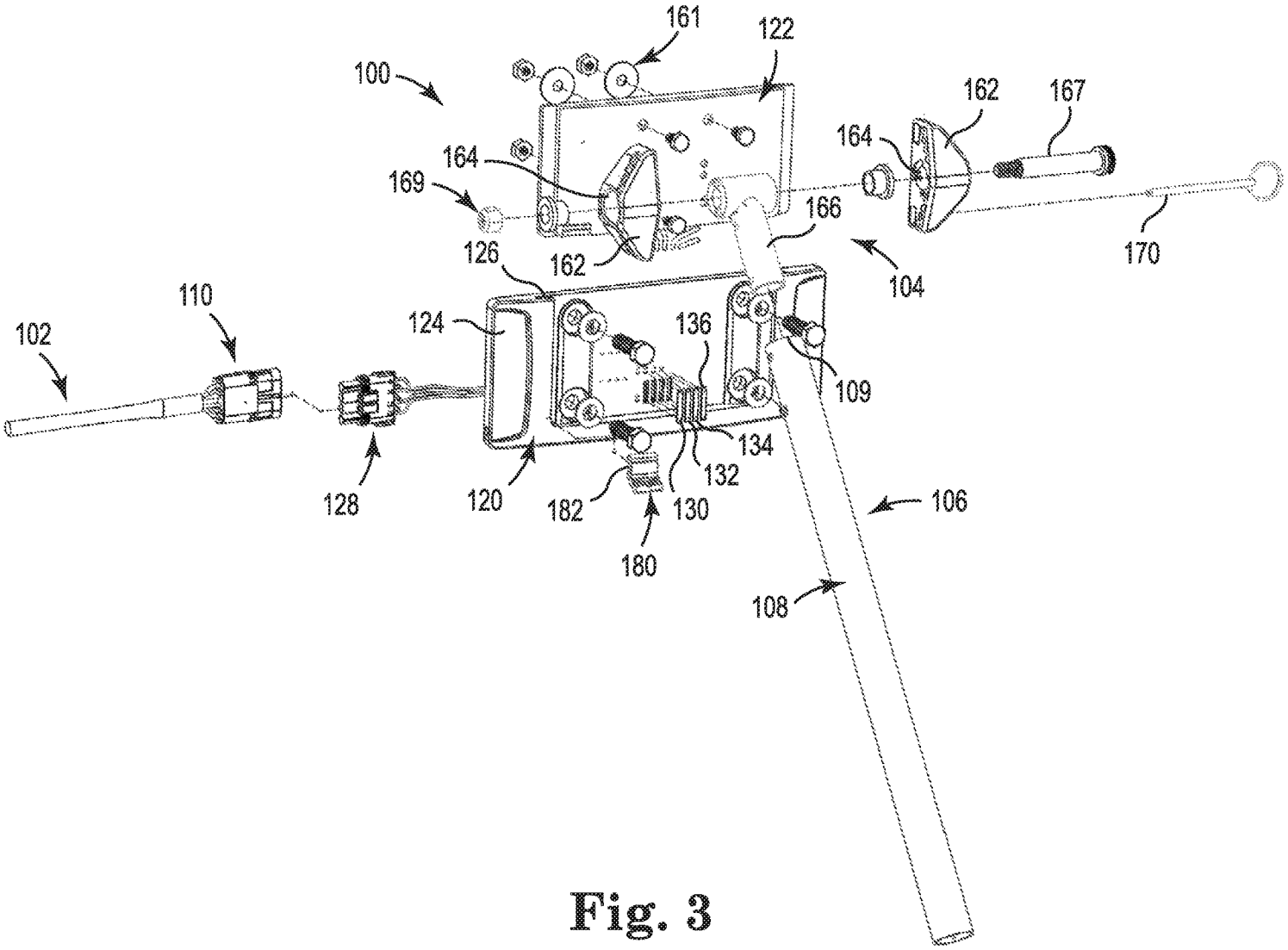
FIG. 3 shows an exploded view of the trolling motor assembly.

In at least the embodiment shown, propeller mounting bracket 122 further comprises shaft mounting bracket 160, which in at least some embodiments allows the shaft to pivot or rotate relative to the outer surface of the boat such that it is at a desired angle relative to the boat. The shaft mounting bracket 160 may be integrally formed with the propeller mounting bracket 122, or as shown in FIGS. 2 and 3, may be mounted to the propeller mounting bracket 122 with a bolt connection 161 or other mechanism for permanent or removable mounting with propeller mounting bracket 122. In at least the embodiment shown, the shaft mounting bracket 160 uses a pin and slot assembly to pivot the shaft at an angle relative to the outer surface of the bracket. The shaft mounting bracket 160 as shown in FIGS. 1-3 comprises two arms 162 bolted to the propeller mounting bracket 122. A receiving sleeve 166, which is pivotable or rotatable with respect to the propeller mounting bracket 122 and shaft mounting bracket 160, may be positioned between the two arms 162 of the shaft mounting bracket. In this embodiment, each arm may have an opening or bore hole 164 for receiving a shaft or bolt 167 that may be fixed between arms 162 with a bolt connection 169 and extend within and through the receiving sleeve 166 and openings 164. Sleeve 166 may thus be rotatable about bolt 167. The receiving sleeve 166 may be attached, and in some cases removably attached, by any suitable connection mechanism to shaft 108 at a proximal end of the shaft. In at least one embodiment, the receiving sleeve 166 may be a T-shaped member such that, depending on the relative size of the diameter of the sleeve and the shaft 108, a portion of the sleeve 166 can be inserted into the inner diameter of the shaft 108, as illustrated, or the shaft 108 can be inserted into an arm of the receiving sleeve 166. The sleeve 166 and the shaft 108 may then be fixedly attached to one another with at least one bolt or screw connection. In other embodiments, the receiving sleeve 166 can be welded to the proximal end of the shaft 108 or can be integrally formed therewith.

In the embodiment shown with the pin and slot assembly, each arm 162 also has a plurality of openings 168 for receiving a pin 170. Without the pin 170 inserted into any of the openings 168, at rest, the shaft will generally rest at around 0 degrees relative to the boat (or in generally a vertically downward position) and the motor may be disposed in the water. When the pin 170 is inserted into the openings 168, the pin 170 passes through one opening on the first arm and another opening on the second arm so that it spans between the two arms 162, and the shaft 108 rests on the pin at a desired angle relative to the boat (e.g. 20 degrees, 30 degrees, 40 degrees, 110 degrees). At many angles less than 90 degrees, the motor will generally be positioned in the water; at angles above 90 degrees (and even at some angles less than 90 degrees), the motor will generally be above the water. To position the shaft 108 at the desired angle relative to the outer surface of the boat, the shaft may be lifted upwards at an angle above the desired angle while the sleeve 166 rotates about bolt 167 extending between and within the openings 164, and then the pin 170 may inserted into one of the plurality of openings 168 of a first arm 162 and across the space between arms and into a corresponding one of the plurality of openings 168 of the second arm 162. The shaft 108 is then released and rests on the pin 170 spanning between the two arms 162. In some embodiments, to assist with lifting and lowering the shaft 108, a strap or rope may be used, and the strap may help secure the shaft 108 in its position. While the embodiment in FIG. 1 shows this pin and slot assembly to pivot the shaft relative to the outer surface of the boat, the propeller mounting bracket 122 may comprise a racheting mechanism or the shaft 108 may be rotated by a motor that receives an electrical signal from the input device of the control assembly to determine the position of the shaft relative to the outer wall surface. In at least one embodiment, the input device may further provide a signal to the mounting assembly 104 that determines the angle of shaft 108 relative to the exterior surface of the boat.

In one embodiment, at least two of the wires connected to the contacts 140, 142, 144, 146 pass through an opening in the first arm 162, into the receiving sleeve 166 at a first end, and then down the shaft 108. Any remaining wires, or alternatively all of the wires, may pass through an opening of the second arm 164, into the receiving sleeve 166 at a second end, and then down the shaft 108. An electrical connector may be provided to connect the wires carried by the shaft 108 with wires or contacts of the propeller mounting bracket 122 and to facilitate the removal of the shaft from the propeller mounting bracket or the shaft mounting bracket 160. The wires transmit signals from the input device to the motor when the propeller mounting bracket and the control mounting bracket are engaged. In some embodiments, when the shaft is in an upright position such that the motor is more than some predetermined distance above the water, the contacts may be configured to prevent the motor from operating.

Figure 4:
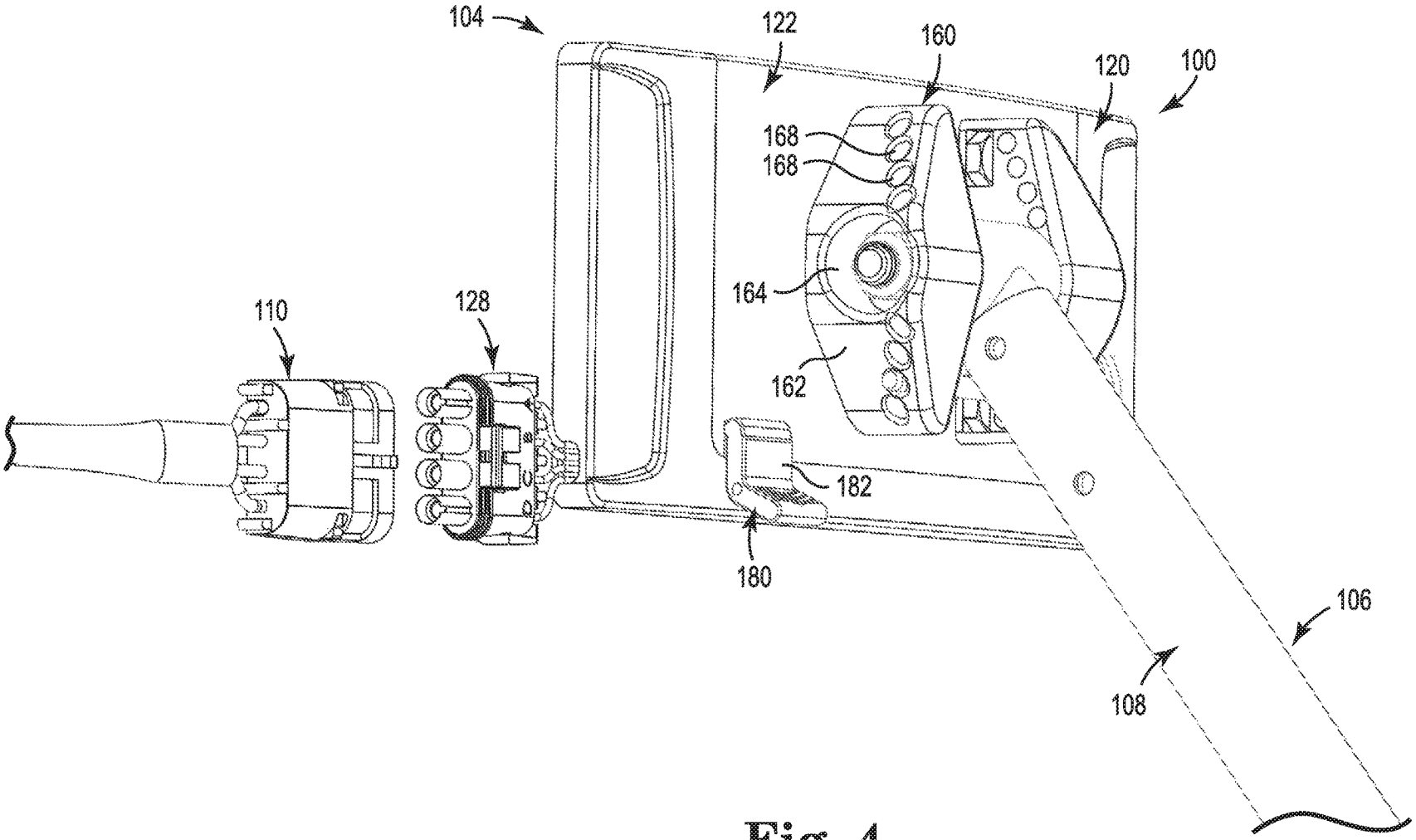
FIG. 4 is a perspective view of a trolling motor assembly of one embodiment of the present disclosure.

In some embodiments, as shown in FIG. 4, the trolling motor assembly 100 may further comprise a locking mechanism 180 to lock the propeller mounting bracket 122 and the control mounting bracket 120. As shown in FIG. 4, the locking mechanism 180 is a tab 182 that can be moved in a downward direction to release the propeller mounting bracket 122 from the control mounting bracket 120 so that a user can release the propeller mounting bracket 122 and remove the motor and propeller. Any other suitable locking mechanisms are suitable as use for the locking mechanism 180 of the present disclosure. The locking mechanism 180 provides a safety feature that prevents the propeller mounting bracket 122, which is connected to the motor and propeller, from being disengaged unintentionally from the control mounting bracket.

In some embodiments, multiple trolling motor assemblies can be used on the same boat or vessel. For example, a first trolling motor assembly can be used on the port side of the boat and the second trolling motor assembly can be used on the starboard side of the boat. In one embodiment, the first trolling motor assembly may be positioned at the same relative position down the length of the boat as the second trolling motor assembly, but at an opposite side. In one embodiment, each trolling motor assembly has its own input device, such that a first input device (e.g. a first joystick) of the first trolling motor assembly operates a first motor and a second input device (e.g. a second joystick) of the second trolling motor assembly operates a second motor. In some embodiments, the first input device and the second input device may be incorporated into the same joystick or controller. In one embodiment, each input device may operate its respective motor in at least forward and reverse speeds. Using the two motor assemblies allows the boat to sharply turn either to the right or left with ease, and also allows the boat the capability of turning up to 360 degrees generally within the boat's own footprint.

Figure 5:
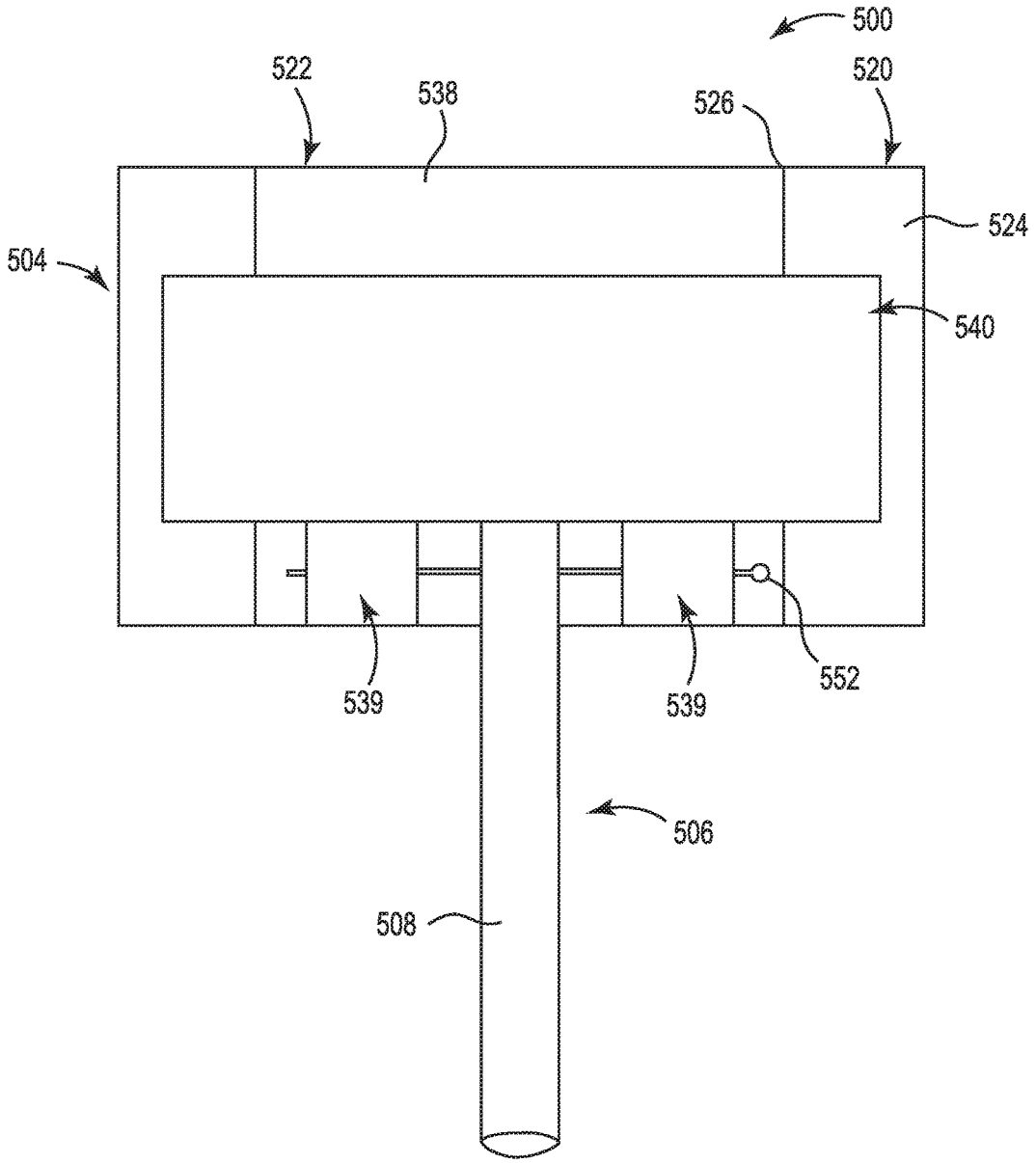
FIG. 5 shows a front view of a trolling motor assembly of one embodiment of the present disclosure.
Figure 6:
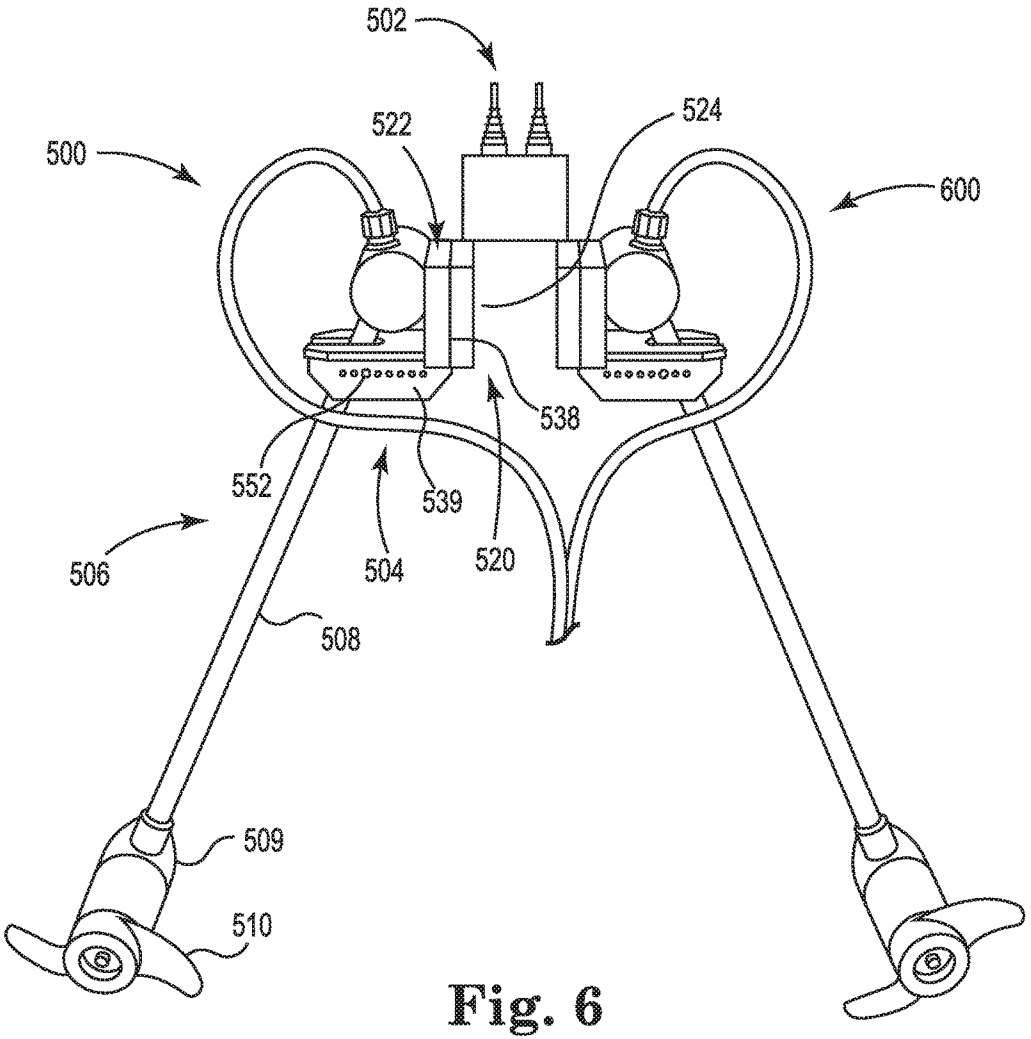
FIG. 6 shows a side view of two trolling motor assemblies of the embodiment shown in FIG. 5.

FIG. 5 shows a schematic front view of another embodiment of the trolling motor assembly 500, and FIG. 6 shows a side view of a first trolling motor assembly 500 and a second trolling motor assembly 600, which are each the same as or generally similar to trolling motor assembly 500. Trolling motor assembly 500 as shown in FIGS. 5 and 6 comprises a control assembly shown generally at 502; a mounting assembly 504 in electrical communication with the control assembly 502; and a propeller assembly shown generally 506 operably connected to the mounting assembly 504 and electrically connected to the control assembly 502. Propeller assembly 506 comprises at least a shaft 508, an electric motor 509 mounted to the shaft 508, and a propeller 510 driven by a propshaft (not shown) rotated by the electric motor 509. The propeller assembly 506 is rotatably connected to the mounting assembly so that shaft 508 is pivotable relative to the wall surface of the boat.

In this embodiment, the mounting assembly 504 comprises a control mounting bracket 520 and a propeller mounting bracket 522. Propeller mounting bracket 522 removably engages with the control mounting bracket 520. As shown in FIG. 5, control mounting bracket 520 comprises a plate 524 with a channel 526 capable of receiving the propeller mounting bracket 522. The control mounting bracket 520 may be removably mounted to the wall of the boat using bolts or another means of attaching the bracket to the boat. As shown in FIGS. 5-6, the propeller mounting bracket 522 comprises a plate 538 with two arms 539 extending generally perpendicularly from the plate 538 with a space therebetween suitable for receiving shaft 508.

In at least one embodiment, the shaft 508 is mounted to a body 540 that either is attached to the plate 538 or rests on the two arms 539 of the mounting bracket 522. In at least the embodiment shown, the body 540 is cylindrical but it may also be rectangular or other desirable forms. The body 540 may include one or more counterweights to keep shaft 508 in the desired position. The shaft 508, which carries electrical wires that control operation of the motor and the propeller, is in electrical communication with the control assembly 502. Additionally, the shaft 508 may be pivotably mounted to the propeller mounting bracket 522 as shown, such that it is capable of being positioned at an angle relative to the outer surface of the boat at an angle between 0 and 180 degrees, as shown in FIG. 6. To position the shaft 508 in at least some of the desired angles, in at least the embodiment shown, a pin and slot assembly is used to rest the shaft at an angle relative to the outer surface of the bracket. The arms 539 have a plurality of openings 550 for receiving pin 552. Without the pin 552 inserted into any of the openings 550, at rest, the shaft 508 will generally rest at around 0 degrees relative to the boat (or in generally a vertically downward position) and the motor may be disposed in the water. To position the shaft 508 at the desired angle relative to the outer surface of the boat, the shaft may be lifted upwards at an angle above the desired angle, and then the pin 552 may inserted into one of the plurality of openings 550 of the first arm 539 and then one of the plurality of openings 550 of the second arm 539, similar to that discussed above with the embodiments of FIGS. 1-4. The shaft 508 is then released and rests on the pin 552 spanning between the two arms 539.

Figure 7:
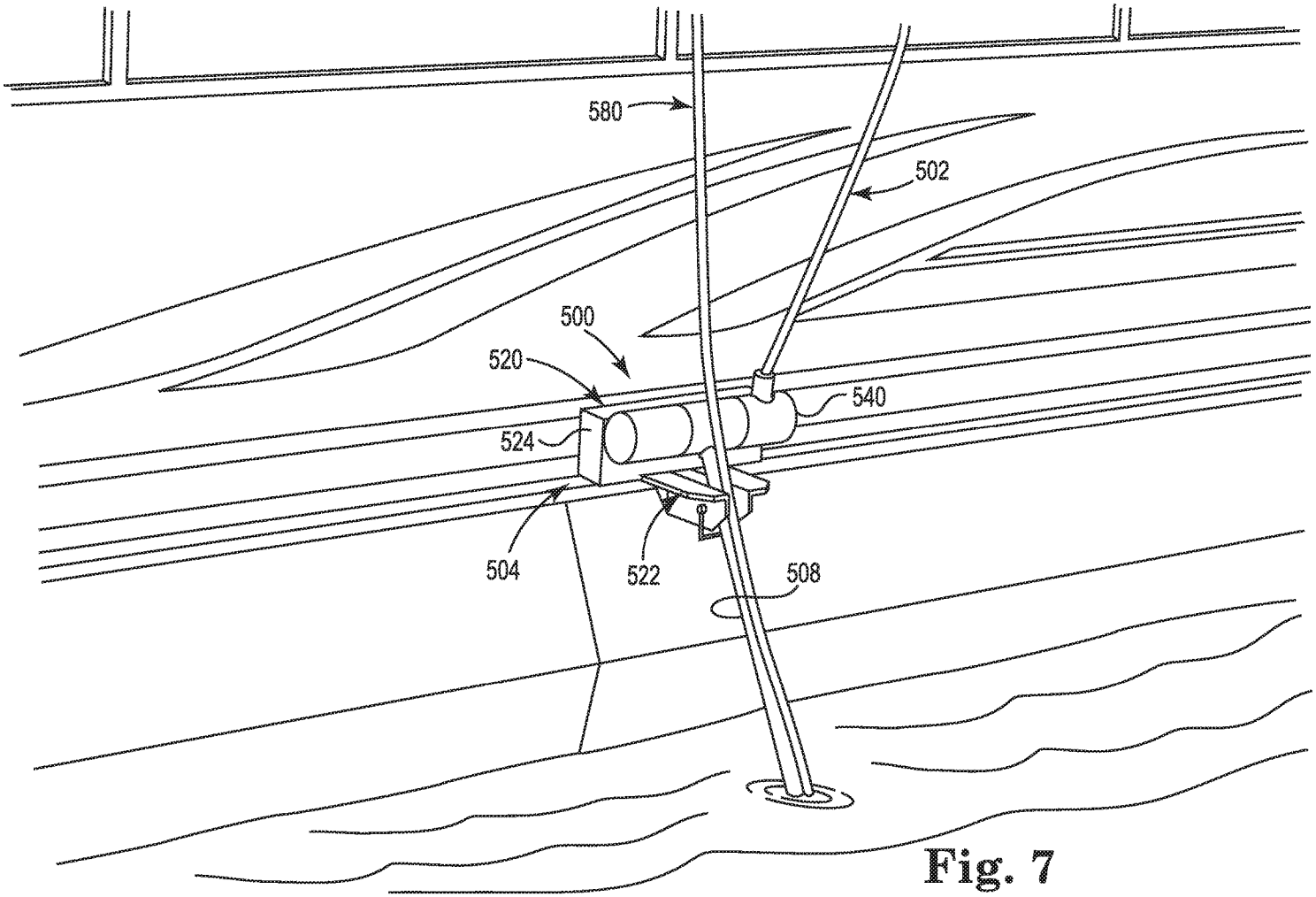
FIG. 7 shows one embodiment of the trolling assembly in a downward position.
Figure 8:
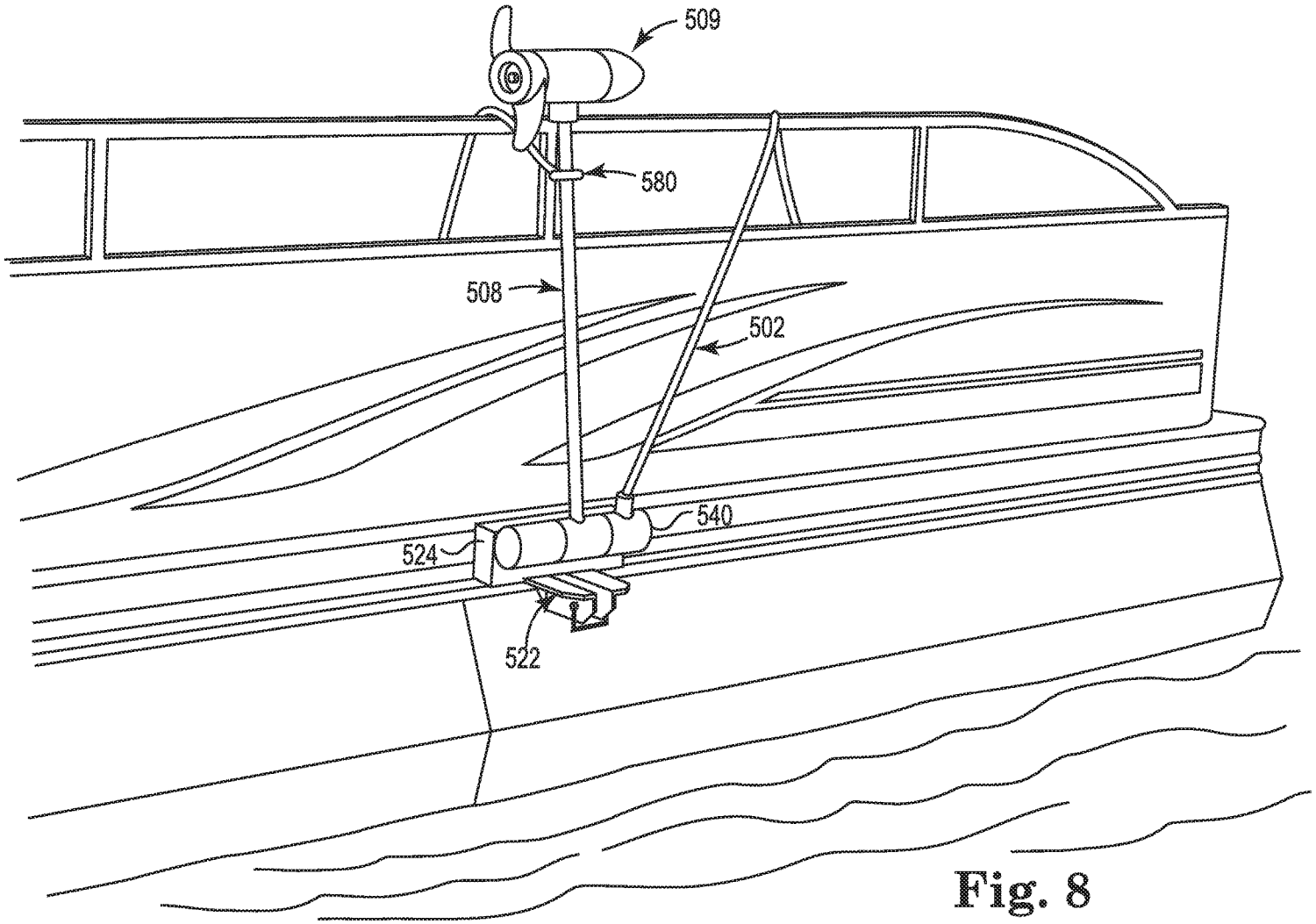
FIG. 8 shows one embodiment of the trolling assembly in an upward position.

FIGS. 7 and 8 show the propeller assembly 506 in the water in a downward position (as shown in FIG. 7) and out of the water in an upward position (as shown in FIG. 8) To assist with lifting and lowering the propeller assembly 506, a strap 580 or rope may be used with the shaft 508, and the strap 580 may help secure the shaft 108 in its position (as shown in FIG. 8).

Figure 9:
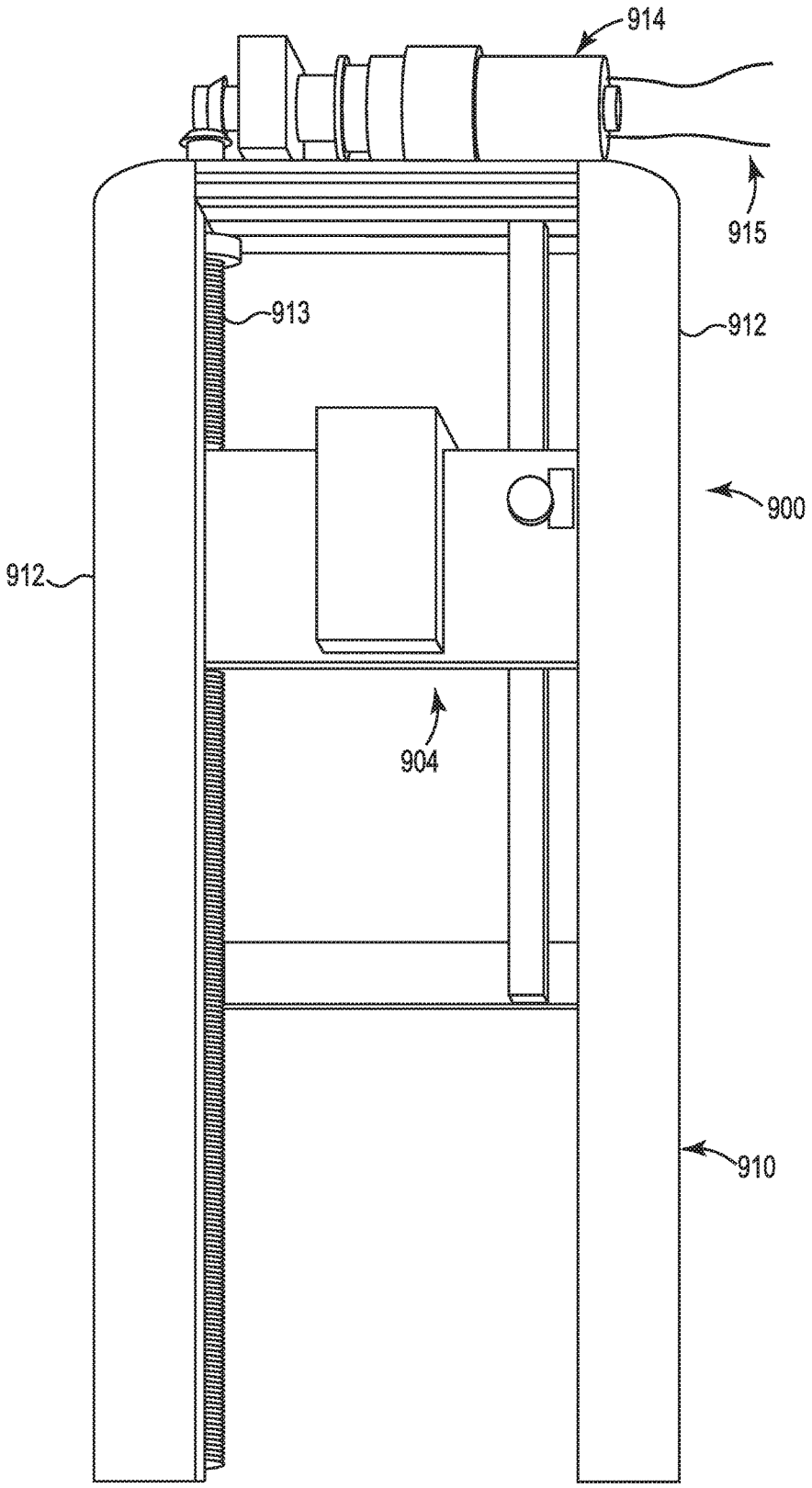
FIG. 9 shows a front view of a trolling motor assembly of one embodiment of the present disclosure.

FIG. 9 shows another embodiment of the trolling motor assembly 900, which comprises a control assembly (not shown) having an input device; a mounting assembly 904; a propeller assembly (not shown) connected to the mounting assembly 904, as discussed above. The mounting assembly 904 may further comprise a control mounting bracket and propeller mounting bracket as discussed above, which may be engaged or disengaged from one another. Trolling motor assembly 900 further comprises a rack assembly 910 capable of being mounted, and in some cases removably mounted through any suitable connecting and disconnecting mechanism, to an exterior surface of the boat. In at least one embodiment, the rack assembly 910 comprises at least two parallel sliding rails 912 with at least one track 913 that is driven by a rack motor 914. A first end and a second end of mounting assembly 904 are connected to one of the rails, respectively. The rack motor 914 is connected to a rack controller with wires 915 which may or may not be connected to the input device of the control assembly 902. An electrical signal from the rack controller is provided to the rack motor 914. When the rack motor 914 is being driven in a first direction, the mounting assembly 904 is moved upward away from the water; when the rack motor 914 is being driven in a second direction, the mounting assembly 904 is moved downward towards the water. The mounting assembly 904 may be positioned at generally any vertical position between fully up and fully down the rack assembly 910. In one embodiment, a feedback mechanism may be used to determine the position of the mounting assembly within the rack assembly. While the rack assembly 910 is shown and described herein for moving the mounting assembly 904 upwards and downwards, with the rails 912 being positioned vertically, rack assembly 910 may also be positioned horizontally to allow the mounting assembly 904 to move horizontally towards the bow or towards the stern, when positioned on the port or starboard side of the boat, or to move horizontally towards the port side or towards the starboard side, when positioned on the bow or stern side of the boat. In some embodiments where multiple trolling motor assemblies are used, each trolling motor assembly may comprise a rack assembly and the rack controller sends each mounting assembly of the trolling motor in the same direction at the same time, or may control each mounting assembly individually.

Figure 10:
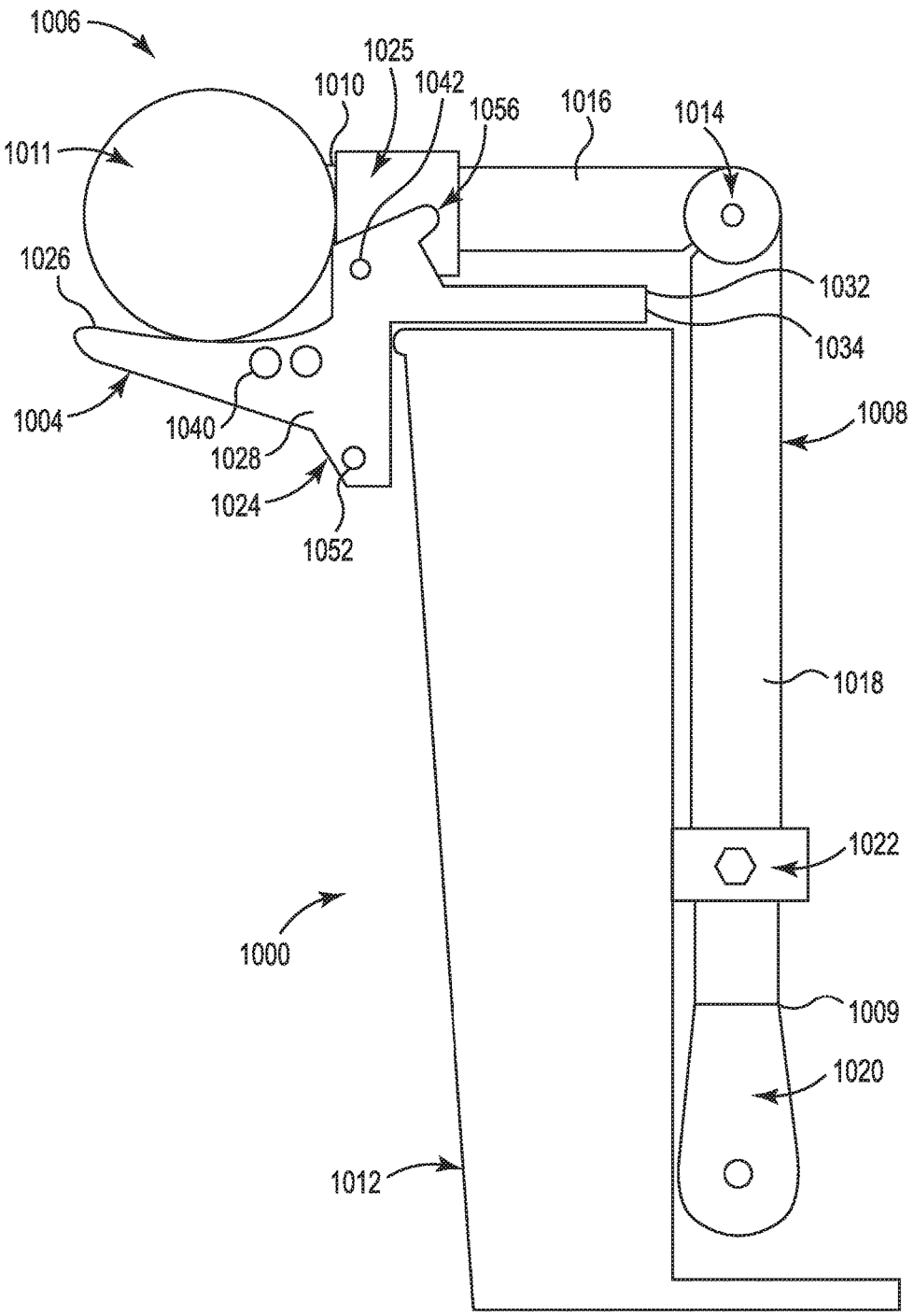
FIG. 10 is a schematic of a side view of a trolling motor assembly of one embodiment of the present disclosure in a retracted position.
Figure 11:
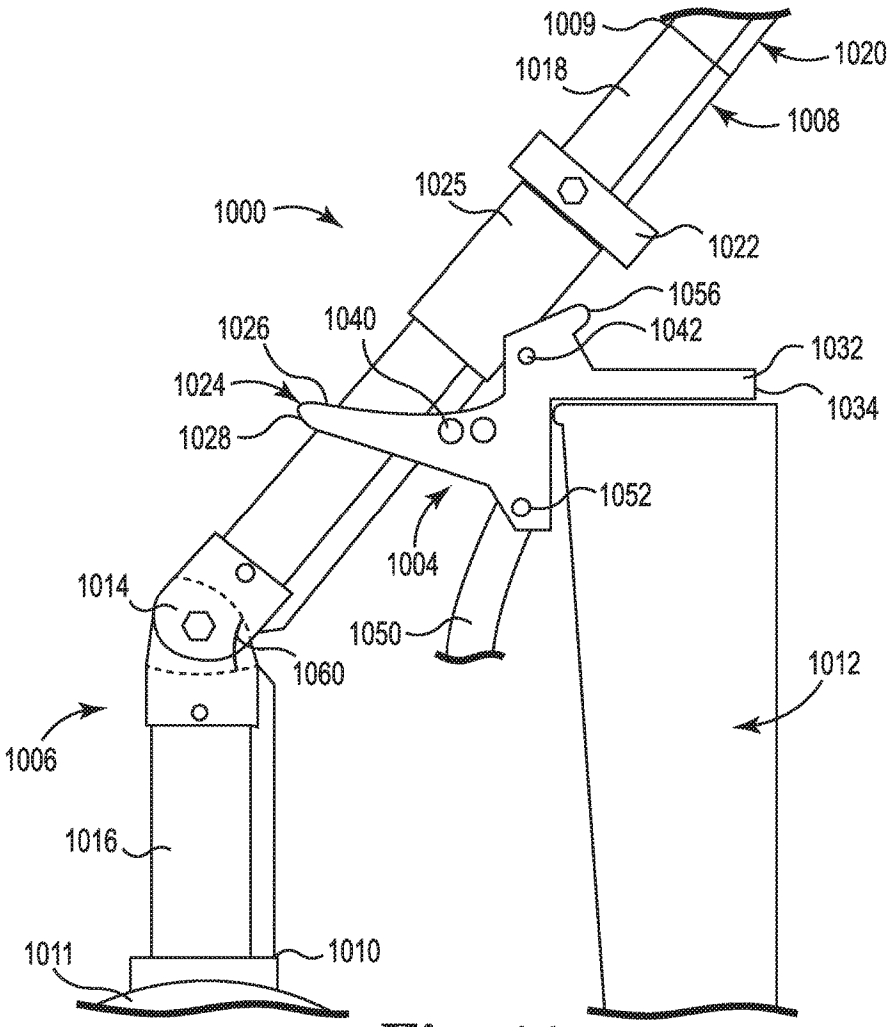
FIG. 11 is a schematic of a side view of the trolling motor assembly of FIG. 10 in a deployed position.

One embodiment of a trolling motor assembly 1000 of the present invention, as shown in FIGS. 10-13, comprises at least a mounting assembly 1004 (which may be in electrical communication with a control assembly (not shown)) and a propeller assembly 1006 connected to the mounting assembly 1004. FIG. 10 shows the trolling motor assembly 1000 in a stowed position, and FIG. 11 shows the trolling motor assembly 1000 in a fully deployed position. The trolling motor assembly may also be positioned in a partially deployed position as described above. In some embodiments, the propeller assembly 1006 comprises at least a shaft 1008 having a proximal end 1009 and a distal end 1010 opposite the proximal end 1009, an electric motor 1010 mounted to the shaft 1008 at its distal end 1010, and a propeller (not shown) driven by a propshaft (not shown) rotated by the electric motor 1011. In at least one embodiment, the mounting assembly 1004 is capable of being attached to a wall surface or gunwale of the boat 1012 along at least one of the port wall, stern wall, bow wall or starboard wall. In some embodiments, the mounting assembly 1004 may be directly attached to a wall surface or gunwale of the boat 1012, or may be clamped to the wall surface or gun wale of the boat 1012. However, it is also contemplated by this invention that the mounting assembly 1004 is adapted to be attached to an interior surface of the boat.

The propeller assembly 1006 is configured to pivot relative to the wall surface of the boat 1012 for convenient storage and deployment of the trolling motor. The shaft 1008 comprises a pivot point 1014 between a lower portion 1016 of the shaft 1008, which is near the distal end 1010, and an upper portion 1018 of the shaft 1008, which is near the proximal end 1009. In at least one embodiment, the shaft 1008 is a keyed shaft. In at least one embodiment, the shaft may further comprise a handle 1020 at the proximal end 1009. The handle 1020 may assist a user in retracting the motor and/or propeller and deploying the motor and/or propeller. Propeller assembly 1006 further comprises a stop 1022 positioned on the upper portion 1018 between the proximal end 1009 and the pivot point 1014. In at least one embodiment, the stop 1022 may be adjustably positioned along the upper portion 1018. The stop 1022 may be clamped, bolted, or otherwise fastened to the upper portion 1018.

Figure 12:
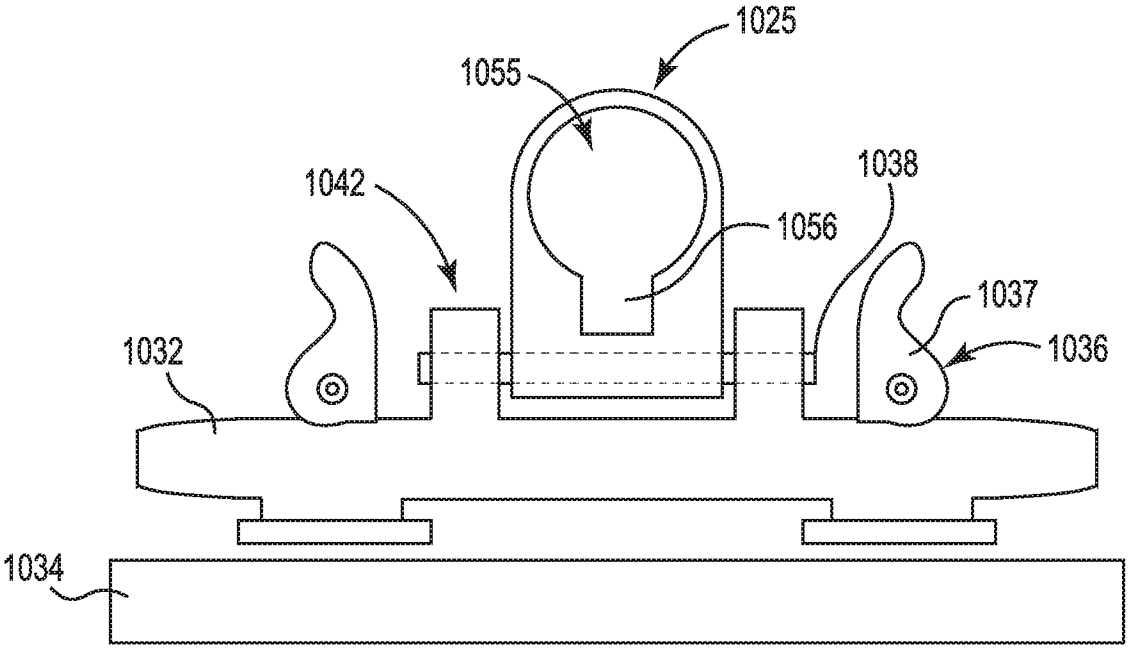
FIG. 12 is a schematic of a front view of a retaining assembly for the trolling motor assembly in FIGS. 10-11.
Figure 13A:
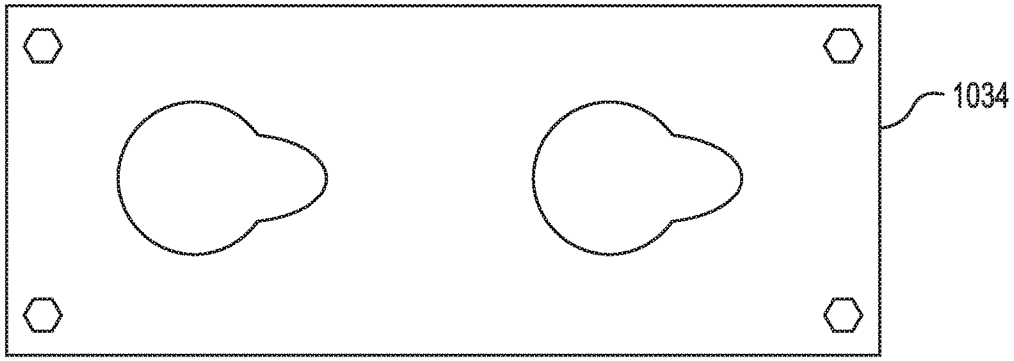
FIGS. 13A-13B show embodiments of a plate of the retaining assembly.
Figure 13B:
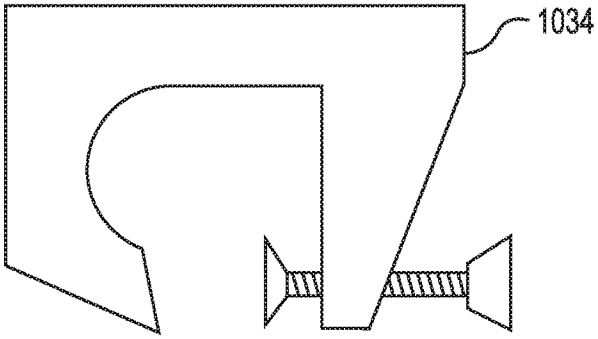

As shown in FIGS. 10-13, mounting assembly 1004 may comprise a mounting bracket 1024 and a pivot guide 1025 rotatably connected to the mounting bracket 1024. The mounting bracket 1024 comprises a motor shelf 1026 for holding the motor in a stowed position. The mounting bracket 1024 may comprise arms 1028 that are separated to allow the shaft 1008 to move relative to the mounting bracket 1024 from a stowed position to a deployed position. Arms 1028 may form the motor shelf 1026. In at least one embodiment, aims 1028 may be connected to a first plate 1032 which is removably connected to a second plate 1034 that is mounted onto the wall or gunwale of the boat 1012. As shown in FIG. 12, The first plate 1032 may be removably connected to the second plate 1034 with a cam locking system 1036 to secure and lock the first plate 1032 to the second plate 1034. The cam locking system, as shown in FIG. 12, comprises at least two cam locks 1037, one on either side of the pivot guide 1025. Second plate 1034 may be bolted onto the wall or gunwale of the boat 1012 and may have a configuration as shown in FIG. 13A, or may be clamped onto the wall or gunwale of the boat 1012 and may have a configuration as shown in FIG. 13B. In at least one embodiment, the mounting bracket 1024 further comprises a first pin and slot assembly 1040 for positioning the propeller assembly 1006 at an angle in a partially deployed position, as discussed above. In at least one embodiment, the mounting bracket 1024 further comprises a second pin and slot assembly 1042 for rotatably connecting the pivot guide 1025 to the mounting bracket 1024.

Pivot guide 1025 may be rotatably connected to the upper plate 1032 by a pin 1038. Pivot guide 1025, as shown in FIG. 12, has a shaft slot 1055 for retaining the shaft. In at least one embodiment where shaft 1008 is a keyed shaft, the pivot guide 1025 has a keyway 1056 for receiving the key of the shaft to prevent rotation of the shaft relative to pivot guide. During retraction or deployment of the motor assembly, the pivot point 1014, at least some of the lower portion 1016, and at least some of the upper portion 1018 may pass through the pivot guide 1025.

To retract the motor and/or propeller from one of a fully deployed position or a partially deployed position, a user pulls upward on the shaft 1008, and in some embodiments, more particularly pulls upward on the handle 1020. The user pulls upward until the lower portion 1016 engages with the pivot guide 1025, and continues to pull until the motor is in the stowed position. In at least one embodiment, the motor 1010 rests on the mounting assembly 1004 (as shown in FIG. 10) in the stowed position. In some embodiments, the user moves the upper portion 1018 into a horizontal position in order to pass the motor and/or propeller 1010 over the mounting assembly 1004 before resting the motor 1010 on the mounting assembly 1004 (as shown in FIG. 10). The upper portion 1018 may then be pivoted relative to the lower portion 1016 into the stowed position. In the stowed position, the upper shaft 1018 may be generally parallel to the wall of the boat 1012 and the lower shaft 1016 may be generally perpendicular to the wall of the boat 1012 or at some other angle relative to the wall of the boat 1012. To secure the propeller assembly 1006 in the stowed assembly, a strap 1050 (shown in FIG. 11) may be wrapped around the motor and secured to the mounting assembly 1004. The strap 1050 may be retained by the mounting bracket 1024 at pin 1052. In some embodiments, the strap 1050 may be secured to retaining lugs 1056 on the mounting bracket 1024.

To deploy the motor from the stowed position shown in FIG. 10 to at least a partially deployed position or the fully deployed position shown in FIG. 11, in at least one embodiment, the strap 150 may be removed from its secured position. The upper portion 1018 may be pivoted from its resting position relative to the lower portion 1016. The shaft 1008 is then pushed outward by the user, in some embodiments using handle 1020. While being pushed outward, at least the lower portion 1016 slides through the pivot guide 1025. Once the pivot point 1014 has passed through the pivot guide 1025, the lower portion 1016 may pivot relative to the upper portion 1018 by the weight of the motor 1010 so that the lower portion 1016 is generally vertical and the upper portion 1018 remains at some other angle. The upper portion 1018 may continue to be pushed through the pivot guide 1025 until the stop 1022 abuts the pivot guide 1025 as shown in FIG. 11. To position the propeller assembly 1006 in a partially deployed position, the upper portion 1018, particularly at handle 1020, may be moved up or down until the upper portion 1018 contacts and rests upon the pin of the first pin and slot assembly 1040.

In this embodiment, the propeller assembly 1006 may be in electrical communication with a control assembly as discussed above. In one embodiment, the motor 1010 may be directly wired to the control assembly. In at least one embodiment, wires 1060 are disposed within the lower shaft 1016 and then on the outer surface of the pivot point 1014 and back within the upper shaft 1018 to the proximal end 1009 of the shaft 1008. The wires may then be connected to the control assembly, which may be similar to the control assembly discussed above. In at least one embodiment, a safety switch may be provided to prevent the motor from operating when the motor is in the stowed position or any other position than a partially or fully deployed position. In some embodiments, the plates 1032, 1034 may each have contacts for electrical communication between the plates when the plates 1032, 1034 are engaged with each other, as discussed above.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

I claim:

1. A trolling motor mounting assembly comprising:

a control mounting bracket configured for electrical communication with a control assembly; and a propeller mounting bracket connected to a propeller assembly, the propeller assembly configured for operable connection with a shaft, a motor, and a propeller;

wherein when the propeller mounting bracket is engaged with the control mounting bracket, the control assembly is in electrical communication with the propeller assembly for operation of the motor, and when the propeller mounting bracket is disengaged with the control mounting bracket, the control assembly is not in electrical communication with the propeller assembly.

2. The trolling motor mounting assembly of claim 1, wherein the control assembly comprises an input device.

3. The trolling motor mounting assembly of claim 2, wherein when the propeller mounting bracket is engaged with the control mounting bracket, the input device provides a signal to the propeller assembly to control at least one of a rotational speed of the propeller, a rotational direction of the propeller, a radial position of the propeller relative to the shaft, and a pitch of the propeller.

4. The trolling motor mounting assembly of claim 1, wherein the propeller assembly is rotatably connected to the propeller mounting bracket.

5. The trolling motor mounting assembly of claim 4, wherein the propeller assembly is positionable between a fully deployed position, a stowed position, or a partially deployed position between the fully deployed position and the stowed position.

6. The trolling motor mounting assembly of claim 1, further comprising the shaft, wherein the shaft comprises a pivot point between a proximal end and a distal end thereof.

7. The trolling motor mounting assembly of claim 1, wherein the control mounting bracket comprises a plate with a channel for receiving the propeller mounting bracket.

8. The trolling motor mounting assembly of claim 1, wherein the control mounting bracket comprises at least one contact configured for electrical communication with the control assembly.

9. The trolling motor mounting assembly of claim 8, wherein the propeller mounting bracket comprises at least one contact for electrical communication with at least one corresponding contact of the control mounting bracket when the propeller mounting bracket is engaged with the control mounting bracket.

10. The trolling motor mounting assembly of claim 1, wherein the propeller mounting bracket comprises a shaft mounting bracket.

11. The trolling motor mounting assembly of claim 10, wherein the shaft mounting bracket comprises a pin and slot assembly.

12. The trolling motor mounting assembly of claim 1, further comprising a locking mechanism for retaining the propeller mounting bracket in an engaged position with the control mounting bracket.

13. The trolling motor assembly of claim 1, further comprising the control assembly, wherein the control assembly is also in electrical communication with a second control mounting bracket, and the control mounting brackets are mounted on opposite walls of a boat.

* * * * *